US006935968B1

(12) United States Patent
Thomas

(10) Patent No.: US 6,935,968 B1
(45) Date of Patent: Aug. 30, 2005

(54) TELESCOPING GOLF CLUB

(75) Inventor: Robert F. Thomas, 104 Coral Way, Key Largo, FL (US) 33037

(73) Assignee: Robert F. Thomas, Key Largo, FL (US)

( * ) Notice: Subject to any disclaimer, the term of this patent is extended or adjusted under 35 U.S.C. 154(b) by 0 days.

(21) Appl. No.: 10/683,834

(22) Filed: Oct. 10, 2003

Related U.S. Application Data

(63) Continuation-in-part of application No. 10/226,888, filed on Aug. 23, 2002, now abandoned.

(51) Int. Cl.[7] ..... A63B 53/16
(52) U.S. Cl. ..... 473/296
(58) Field of Search ..... 473/296, 239; 403/109.8, 109.5

(56) References Cited

U.S. PATENT DOCUMENTS

| | | | | |
|---|---|---|---|---|
| 1,622,864 | A | 3/1927 | Findlay | |
| 3,829,092 | A | 8/1974 | Arkin | 273/77 A |
| 5,029,860 | A | 7/1991 | Ehrich | 273/81.2 |
| 5,133,553 | A | 7/1992 | Divnick | 273/79 |
| 5,356,235 | A | 10/1994 | Brown et al. | 403/350 |

*Primary Examiner*—Stephen Blau

(57) ABSTRACT

A telescoping golf club includes a tubular proximal shaft segment; a tubular intermediate shaft segment telescopically and slidingly fitting into the proximal shaft segment; a distal shaft segment telescopically and slidingly fitting into the intermediate shaft segment and including a shaft distal end; a club head fastened to the shaft distal end; and a shaft segment stop structure preventing the intermediate shaft segment from sliding entirely out of the proximal shaft segment and preventing the distal shaft segment from sliding entirely out of the intermediate shaft segment.

12 Claims, 2 Drawing Sheets

TELESCOPING GOLF CLUB

FILING HISTORY

This application is a continuation-in-part of application Ser. No. 10/226,888 filed on Aug. 23, 2002 now abandoned.

BACKGROUND OF THE INVENTION

1. Field of the Invention

The present invention relates generally to the field of sports equipment. More specifically the present invention relates to a golf club having a club head and a telescoping club shaft for extending from a conventional shaft length to a conspicuously exaggerated length for surprising and entertaining either fellow players or a person receiving the inventive club as a gift. The club head may be of any conventional driver, wedge or putter configuration, or of a creative configuration. The club shaft has a shaft proximal end preferably including a handle grip and a shaft distal end connected to the club head, and includes at least two telescoping shaft segments, and preferably a proximal shaft segment, at least one intermediate shaft segment and a distal shaft segment in the form of tubes of progressively decreasing diameter in the direction of the shaft distal end. Interior and exterior shaft segment collars guide the shaft segments smoothly, axially and with light friction resistance when the club shaft is telescopically extended and retracted to releasibly hold the club shaft in its extended or retracted mode, and include notch and projection clutch means to prevent the shaft segments from rotating relative to each other when the club shaft is fully retracted.

2. Description of the Prior Art

There have long been golf clubs for driving a ball long distances over a driving range, out of a trap or short distances over the green. Yet none of these club designs has been designed to introduce levity and good natured fun into the game, or to provide a golfer with an entertaining surprise gift.

Arkin, U.S. Pat. No. 3,829,092, issued on Aug. 13, 1974, discloses a set of golf clubs and means for carrying the clubs. Brown, et al., U.S. Pat. No. 5,356,235, issued on Oct. 18, 1994, teaches a locking mechanism for a golf club. Findlay, U.S. Pat. No. 1,622,864, issued on Mar. 29, 1927, reveals a golf putter and method of forming the golf putter. Ehrich, U.S. Pat. No. 5,029,860, issued on Jul. 9, 1991, discloses a collapsible golf club.

It is thus an object of the present invention to provide a golf club having a telescoping club shaft which can be retracted to substantially the conventional length of such a club shaft and which can be extended to a significantly greater length for an entertaining visual effect.

It is another object of the present invention to provide such a golf club which includes telescoping club shaft segments having collars surrounding and secured to the segments abut opposing collars and thereby stop shaft retraction at a certain point.

It is still another object of the present invention to provide such a golf club in which the opposing collars having opposing locking projections sized to fit into locking notches of an opposing collar to prevent axial rotation of one segment relative to another.

It is yet another object of the present invention to provide such a golf club in which the locking projections and locking notches have rounded corners which bear against each other to laterally displace and guide each locking projection as the locking projection is advanced into the opposing locking notch.

It is finally an object of the present invention to provide such a golf club which is sturdy, reliable and economical to manufacture.

SUMMARY OF THE INVENTION

The present invention accomplishes the above-stated objectives, as well as others, as may be determined by a fair reading and interpretation of the entire specification.

A golf club is provided, including a club head; a telescoping club shaft having at least two telescoping shaft segments and having a shaft proximal end and a shaft distal end connected to the club head. The telescoping golf club preferably additionally includes a conventional handle grip covering at least a portion of the shaft proximal end.

A telescoping golf club is further provided, including a tubular proximal shaft segment; a tubular intermediate shaft segment telescopically and slidingly fitting into the proximal shaft segment; a distal shaft segment telescopically and slidingly fitting into the intermediate shaft segment and including a shaft distal end; a club head fastened to the shaft distal end; and a shaft segment stop structure preventing the intermediate shaft segment from sliding entirely out of the proximal shaft segment and preventing the distal shaft segment from sliding entirely out of the intermediate shaft segment.

The proximal shaft segment and the intermediate shaft segment each have an interior surface and the intermediate shaft segment and the distal shaft segment each have an exterior surface; and the shaft segment stop preferably includes a first extension stop collar fastened to the interior surface of the proximal shaft segment, the first extension stop collar having an interior diameter sized so that the intermediate shaft segment fits slidingly inside the first extension stop collar and telescopingly within the proximal shaft segment; a second extension stop collar fastened to the interior surface of the intermediate shaft segment, the second extension stop collar having an interior diameter sized so that the distal shaft segment fits slidingly inside the second extension stop collar and telescopingly within the intermediate shaft segment; a first retraction stop collar fastened to the interior surface of the proximal shaft segment; a second retraction stop collar fastened to the interior surface of the intermediate shaft segment; and a first dual abutment collar fastened to the exterior surface of the intermediate shaft segment and sized in exterior diameter so that the proximal shaft segment fits slidingly around and over the second dual abutment collar; a second dual abutment collar fastened to the exterior surface of the distal shaft segment and sized in exterior diameter so that the intermediate shaft segment fits slidingly around and over the first dual abutment collar; so that the first retraction stop collar abuts the first dual abutment collar and the second retraction stop collar simultaneously abuts the second dual abutment collar upon full telescopic retraction of the club shaft, and so that the first extension stop collar abuts the first dual abutment collar and the second extension stop collar simultaneously abuts the second dual abutment collar upon full telescopic extension of the club shaft.

The first dual abutment collar preferably is located adjacent to the proximal end of the intermediate shaft segment and the second dual abutment collar is located adjacent to the proximal end of the distal shaft segment; and the first extension stop collar is located adjacent to the distal end of the intermediate shaft segment and the second extension stop collar is located adjacent to the distal end of the distal shaft segment.

The first and second retraction stop collars each include a circumferential collar distal edge divided into a collar locking notch and a collar locking projection; and the first and second dual abutment collars each include a circumferential collar proximal edge divided into a collar locking notch and a collar locking projection; so that interlocking of collar locking notches and collar locking projections causes the retraction stop collars and the dual abutment collars to function to prevent axial rotation of the respective shaft segments to which they are attached.

The locking projections preferably include projection outward ends and rounded projection centering corners at the projection outward ends, which are also the outward corners of adjacent the notches, so that as a projection is advanced toward an opposing notch and yet is laterally offset a certain distance from the notch, the rounded projection centering corners of opposing locking projections contact each other and cause the locking projections to advance progressively into, and slide laterally toward a position centered over the opposing notch and, when centered, the projection enters and slides fully into the notch. Each collar locking notch and each collar locking projection preferably constitutes substantially 180 degrees of the given circumferential collar distal edge. The club head preferably includes a club head bore into which the club shaft proximal end is fitted and secured.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
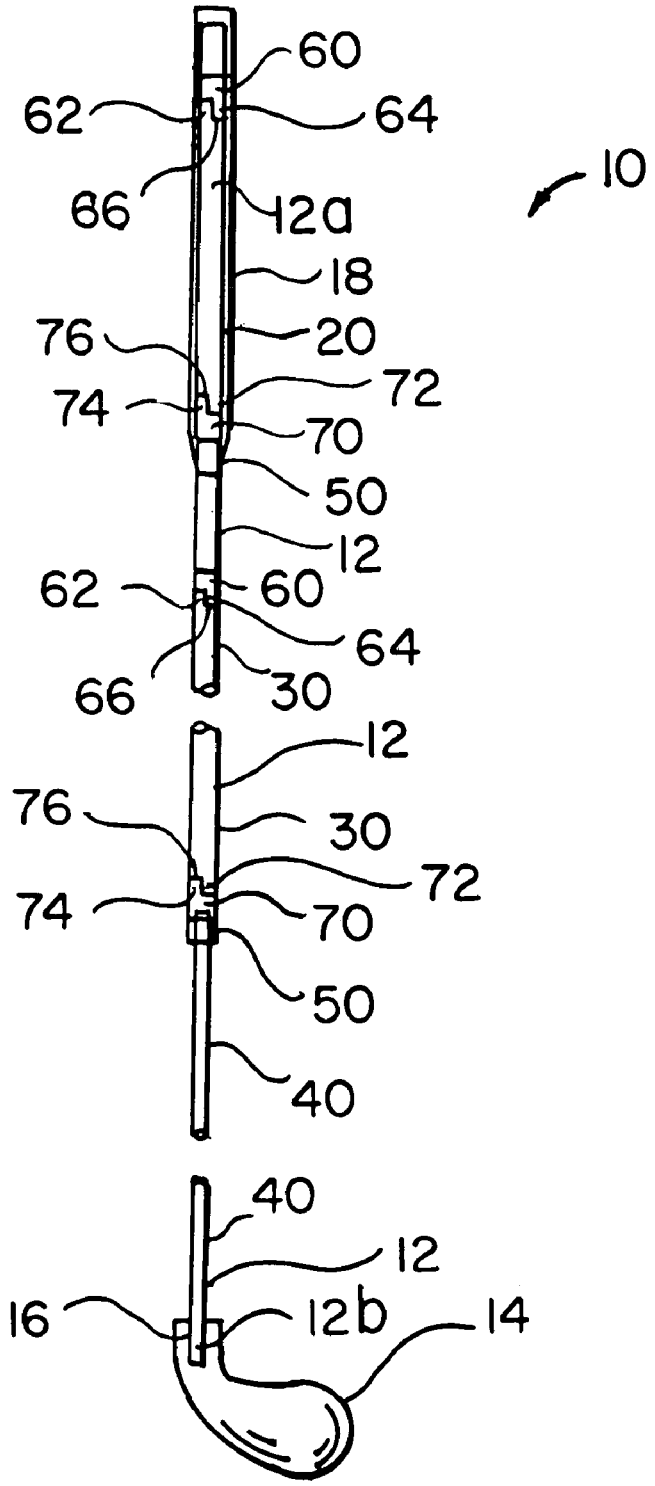
FIG. 1 is a cross-sectional side view of the inventive telescoping golf club in its extended position.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
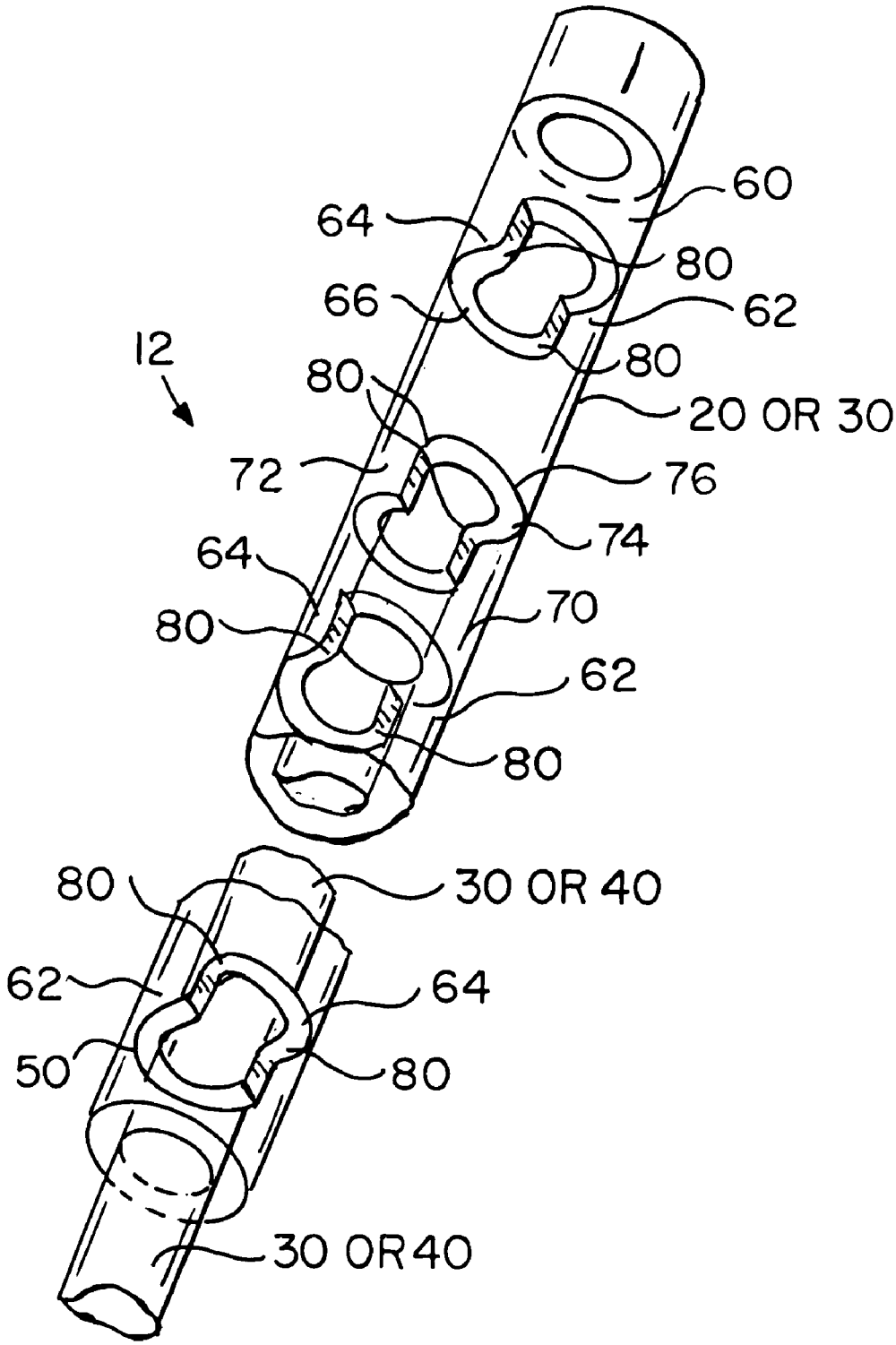
FIG. 2 is a perspective side view of two of the shaft segments of the telescoping club shaft, showing the system of interior and exterior collars and their operational relationships.

Referring to FIGS. 1–2, a golf club 10 is disclosed including a club shaft 12 which telescopes and a club head 14 having any one of many conventional or inventive driver, wedge or putter configurations. Club shaft 12 has a shaft proximal end 12*a* preferably covered by a conventional handle grip 18 and a shaft distal end 12*b* connected to club head 14, and includes at least two telescoping shaft segments, and a proximal shaft segment 20, at least one intermediate shaft segment 30 and a distal shaft segment 40 in the form of tubes of progressively decreasing diameter fit one over the next in the direction of shaft distal end 12*b*.

A system of interior and exterior shaft segment collars guides the shaft segments 20, 30 and 40 smoothly, axially and with light friction resistance when the club shaft 12 is telescopically extended and retracted, and prevents the shaft segments 20, 30 and 40 from rotating relative to each other when the club shaft 12 is fully retracted. See FIG. 2. The follow system of telescoping shaft segments and stop collars, including the below-described means for locking the shaft segments against rotation relative to each other, may be incorporated into the present club shaft 12 or may be used in entirely separate applications.

An extension stop collar 50 is fastened to the interior surface of the proximal shaft segment 20 and of any intermediate shaft segments 30, preferably adjacent to the given shaft segment distal end, and has an interior diameter sized such that the next shaft segment 30 or 40 fitting telescopically inside given shaft segment 20 or 30, respectively, fits and slides with light friction resistance within the extension stop collar 50. The light friction resistances prevent free sliding and flopping of the club shaft 12 between extended and retracted telescopic positions.

A retraction stop collar 60 is fastened to the interior surface of the proximal shaft segment 20 and of any intermediate shaft segments 30, preferably adjacent to the given shaft segment 20 or 30 proximal end, and is sized in interior diameter such that the next shaft segment 30 or 40 fitting telescopically inside the given shaft segment 20 or 30 respectively enters upon shaft 12 retraction, and exits upon shaft 12 extension, and fits and slides with light friction resistance within the retraction stop collar 60. Each retraction stop collar 60, each extension stop collar 50 and each dual abutment collar 70 preferably also includes a circumferential collar distal edge divided into a collar locking notch 62 and a collar locking projection 64. Collar locking notches 62 and collar locking projections 64 of abutting collars 60 and 70, and 70 and 50, respectively, prevent relative rotation of shaft segments 20, 30 and 40 when these shaft segments are telescoped to full retraction and also when telescoped to full extension. The collar locking notch 62 and collar locking projection 64 preferably each constitute 180 degrees of the circumferential collar distal edge 66.

A dual abutment collar 70 is fastened to the exterior surface of the distal shaft segment 40 and of any intermediate shaft segments 30, preferably adjacent to the given shaft segment 40 or 30 proximal end, and is sized in exterior diameter such that the shaft segment 30 or 20 fitting telescopically outside the given shaft segment 40 or 30, respectively, fits slidingly with light friction resistance around and over the dual abutment collar 70. Once again, each dual abutment collar 70 preferably also includes a circumferential collar proximal edge 76 divided into a collar locking notch 72 and a collar locking projection 74. And, once again, the collar locking notch 72 and collar locking projection 74 preferably each constitute 180 degrees of the circumferential collar proximal edge 76.

The retraction stop collar 60 and dual abutment collar 70 function to stop the given inner shaft segment 30 or 40 at a certain point of retraction into the given surrounding outer shaft segment 20 or 30, respectively. In addition, the interlocking of collar locking notches 62 and 72 and collar locking projections 64 and 74, respectively, also causes collars 60 and 70 and collars 70 and 50 to function to prevent axial rotation of the given inner shaft segment 30 or 40 relative to the given surrounding outer shaft segment 20 or 30. The retraction stop collars 60 and dual abutment collars 70 preferably are fastened to the respective surfaces of the corresponding shaft segments 20, 30 and 40 with LOCTITE™, epoxy or some other suitable glue, adhesive or cement.

The collar locking projections 64 and 74 preferably have rounded projection centering corners 80 at the projection outward ends 68 and 78, respectively, which are also the outward corners of the adjacent notches 62 and 72. See FIG. 2. A projection 64 or 74 is advanced toward an opposing notch 72 or 62, respectively, the rounded projection centering corners 80 contact each other and cause the projection 64 or 74 to advance progressively into, while sliding laterally toward, a position centered over the notch 72 or 62, respectively. When centered, the projection 64 or 74 enters and slides entirely into the notch 72 or 62. In other words, opposing corners 80 define bearing surfaces which slide against and along each other and thereby laterally displace and guide the locking projections 64 and 74 into notches 62 and 72. Projection centering corners 80 on opposing sides of a given projection 64 or 74 are optionally rounded to an extent that they meet to define a fully and continuously rounded projection outward end 68 or 78.

It is contemplated that a locking mechanism (not shown) may be provided for releasibly locking the club shaft 12 in an extended position and for releasibly locking the club shaft 12 in a retracted position. For example a locking gripping device may be placed at the distal end of the proximal shaft segment 20 and of the intermediate shaft segment 30.

The club head 14 preferably has a club head bore 16 into which the club shaft proximal end 12 is closely fitted and secured with a suitable bonding agent, such as LOCTITE™ or epoxy. Since the shaft segments 20, 30 and 40 preferably rotate axially one within the other when extended, the distal shaft segment 40 rotates freely relative to the handle grip 18 when a torque about the club shaft 12 longitudinal axis is applied to the club head 14. As a result, the golf club 10 is suitable only for putting because the club head 14 would spin around with greater ball impact such as from driving, and thus this feature prevents dangerous and unintended use of the club for long distance driving. The club shaft 12 as well as the collars 50, 60 and 70 preferably are formed of fiberglass, steel, plastic or special carbon and titanium alloys.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A telescoping golf club, comprising:

a tubular proximal shaft segment;

a tubular intermediate shaft segment telescopically and slidingly fitting into said proximal shaft segment;

a distal shaft segment telescopically and slidingly fitting into said intermediate shaft segment and comprising a shaft distal end;

a club head fastened to said shaft distal end;

and shaft segment stop means preventing said intermediate shaft segment from sliding entirely out of said proximal shaft segment and preventing said distal shaft segment from sliding entirely out of said intermediate shaft segment;

wherein said proximal shaft segment and said intermediate shaft segment each have an interior surface and wherein said intermediate shaft segment and said distal shaft segment each have an exterior surface;

and wherein said shaft segment stop means comprises:

a first extension stop collar fastened to the interior surface of said proximal shaft segment, said first extension stop collar having an interior diameter sized such that said intermediate shaft segment fits slidingly inside said first extension stop collar and telescopingly within said proximal shaft segment;

a second extension stop collar fastened to the interior surface of said intermediate shaft segment, said second extension stop collar having an interior diameter sized such that said distal shaft segment fits sligingly inside said second extension stop collar and telescopingly within said intermediate shaft segment;

a first retraction stop collar fastened to the interior surface of said proximal shaft segment;

a second retraction stop collar fastened to the interior surface of said intermediate shaft segment;

and a first dual abutment collar fastened to the exterior surface of said intermediate shaft segment and sized in exterior diameter such that said proximal shaft segment fits slidingly around and over said second dual abutment collar;

a second dual abutment collar fastened to the exterior surface of said distal shaft segment and sized in exterior diameter such that said intermediate shaft segment fits slidingly around and over said first dual abutment collar;

such that said first retraction stop collar abuts said first dual abutment collar and said second retraction stop collar simultaneously abuts said second dual abutment collar upon full telescopic retraction of said club shaft, and such that said first extension stop collar abuts said first dual abutment collar and said second extension stop collar simultaneously abuts said second dual abutment collar upon full telescopic extension of said club shaft;

wherein said first and second retraction stop collars each comprise a circumferential collar distal edge divided into a collar locking notch and a collar locking projection;

and wherein said first and second dual abutment collars each comprise a circumferential collar proximal edge divided into a collar locking notch and a collar locking projection;

such that interlocking of collar locking notches and collar locking projections causes said retraction stop collars and said dual abutment collars to function to prevent axial rotation of the respective shaft segments to which they are attached.

2. The telescoping golf club of claim 1, wherein said first and second extension stop collars each comprise a circumferential collar proximal edge divided into a collar locking notch and a collar locking projection;

and wherein said first and second dual abutment collars each comprise a circumferential collar distal edge divided into a collar locking notch and a collar locking projection;

such that interlocking of collar locking notches and collar locking projections causes said extension stop collars and said dual abutment collars to function to prevent axial rotation of the respective shaft segments to which they are attached.

3. The telescoping golf club of claim 1, wherein said locking projections comprise projection outward ends and rounded projection centering corners at said projection outward ends, which are also the outward corners of adjacent said notches, such that as a projection is advanced toward an opposing notch and yet is laterally offset a certain distance from the notch, the rounded projection centering corners of opposing locking projections contact each other and cause the locking projections to advance progressively into, and slide laterally toward a position centered over the opposing notch and, when centered, the projection enters and slides fully into the notch.

4. The telescoping golf club of claim 1, wherein each said collar locking notch and each said collar locking projection constitutes substantially 180 degrees of the given circumferential collar distal edge.

5. The telescoping golf club of claim 1, wherein said club head comprises a club head bore into which said club shaft proximal end is fitted and secured.

6. A telescoping shaft, comprising:

a tubular proximal shaft segment;

a tubular intermediate shaft segment telescopically and slidingly fitting into said proximal shaft segment;

a distal shaft segment telescopically and slidingly fitting into said intermediate shaft segment and comprising a shaft distal end;

and shaft segment stop means preventing said intermediate shaft segment from sliding entirely out of said proximal shaft segment and preventing said distal shaft segment from sliding entirely out of said intermediate shaft segment;

wherein said proximal shaft segment and said intermediate shaft segment each have an interior surface and wherein said intermediate shaft segment and said distal shaft segment each have an exterior surface;

and wherein said shaft segment stop means comprises: a first extension stop collar fastened to the interior surface of said proximal shaft segment, said first extension stop collar having an interior diameter sized such that said intermediate shaft segment fits slidingly inside said first extension stop collar and telescopingly within said proximal shaft segment; a second extension stop collar fastened to the interior surface of said intermediate shaft segment, said second extension stop collar having an interior diameter sized such that said distal shaft segment fits slidingly inside said second extension stop collar and telescopingly within said intermediate shaft segment; a first retraction stop collar fastened to the interior surface of said proximal shaft segment; a second retraction stop collar fastened to the interior surface of said intermediate shaft segment; and a first dual abutment collar fastened to the exterior surface of said intermediate shaft segment and sized in exterior diameter such that said proximal shaft segment fits slidingly around and over said second dual abutment collar; a second dual abutment collar fastened to the exterior surface of said distal shaft segment and sized in exterior diameter such that said intermediate shaft segment fits slidingly around and over said first dual abutment collar; such that said first retraction stop collar abuts said first dual abutment collar and said second retraction stop collar simultaneously abuts said second dual abutment collar upon full telescopic retraction of said shaft, and such that said first extension stop collar abuts said first dual abutment collar and said second extension stop collar simultaneously abuts said second dual abutment collar upon full telescopic extension of said shaft;

wherein said first and second retraction stop collars and said first and second dual abutment collars comprise relative rotation stop means preventing relative axial rotation of the respective shaft segments to which they are attached.

7. The telescoping shaft of claim 6, wherein said first dual abutment collar is located adjacent to the proximal end of said intermediate shaft segment and wherein said second dual abutment collar is located adjacent to the proximal end of said distal shaft segment;

and wherein said first extension stop collar is located adjacent to the distal end of said proximal shaft segment and wherein said second extension stop collar is located adjacent to the distal end of said intermediate shaft segment.

8. The telescoping shaft of claim 6, wherein said first and second retraction stop collars each comprise a circumferential collar distal edge, and wherein said relative rotation stop means comprises divisions of said circumferential collar distal edges into a collar locking notch and a collar locking projection;

and wherein said first and second dual abutment collars each comprise a circumferential collar proximal edge divided into a collar locking notch and a collar locking projection;

such that interlocking of collar locking notches and collar locking projections causes said retraction stop collars and said dual abutment collars to function to prevent axial rotation of the respective shaft segments to which they are attached.

9. The telescoping shaft of claim 8, wherein said first and second extension stop collars each comprise a circumferential collar proximal edge divided into a collar locking notch and a collar locking projection;

and wherein said first and second dual abutment collars each comprise a circumferential collar distal edge divided into a collar locking notch and a collar locking projection;

such that interlocking of collar locking notches and collar locking projections causes said extension stop collars and said dual abutment collars to function to prevent axial rotation of the respective shaft segments to which they are attached.

10. The telescoping shaft of claim 8, wherein said locking projections comprise projection outward ends and rounded projection centering corners at said projection outward ends, which are also the outward corners of adjacent said notches, such that as a projection is advanced toward an opposing notch and yet is laterally offset a certain distance from the notch, the rounded projection centering corners of opposing locking projections contact each other and cause the locking projections to advance progressively into, and slide laterally toward a position centered over the opposing notch and, when centered, the projection enters and slides fully into the notch.

11. The telescoping shaft of claim 8, wherein each said collar locking notch and each said collar locking projection constitutes substantially 180 degrees of the given circumferential collar distal edge.

12. A telescoping golf club, comprising:

a tubular proximal shaft segment;

a tubular intermediate shaft segment telescopically and slidingly fitting into said proximal shaft segment;

a distal shaft segment telescopically and slidingly fitting into said intermediate shaft segment and comprising a shaft distal end;

and shaft segment stop means preventing said intermediate shaft segment from sliding entirely out of said proximal shaft segment and preventing said distal shaft segment from sliding entirely out of said intermediate shaft segment;

wherein said proximal shaft segment and said intermediate shaft segment each have an interior surface and wherein said intermediate shaft segment and said distal shaft segment each have an exterior surface;

and wherein said shaft segment stop means comprises: a first extension stop structure fastened to the interior surface of said proximal shaft segment, said first extension stop structure being sized such that said intermediate shaft segment fits slidingly adjacent said first extension stop structure and telescopingly within said proximal shaft segment; a second extension stop structure fastened to the interior surface of said intermediate shaft segment, said second extension stop structure being sized such that said distal shaft segment fits slidingly adjacent said second extension stop structure and telescopingly within said intermediate shaft segment; a first retraction stop structure fastened to the interior surface of said proximal shaft segment; a second retraction stop structure fastened to the interior surface of said intermediate shaft segment; and a first dual abutment structure fastened to the exterior surface of said intermediate shaft segment and sized such that said proximal shaft segment fits slidingly around and over said second dual abutment structure; a second dual abutment structure fastened to the exterior surface of said distal shaft segment and sized such that said intermediate shaft segment fits slidingly around and over said first dual abutment structure; such that said first retraction stop structure abuts said first dual abutment structure and said second retraction stop structure simultaneously abuts said second dual abutment structure upon full telescopic retraction of said shaft, and such that said first extension stop structure abuts said first dual abutment structure and said second extension stop structure simultaneously abuts said second dual abutment structure upon full telescopic extension of said shaft;

wherein said first and second retraction stop structures and said first and second dual abutment structures comprise relative rotation stop means preventing relative axial rotation of the respective shaft segments to which they are attached.

* * * * *